343-872 SR
7/17/84 OR 4,460,901

United States Patent [19]
Tricoles et al.

[11] Patent Number: 4,460,901
[45] Date of Patent: Jul. 17, 1984

[54] INTEGRATED ANTENNA-RADOME STRUCTURE THAT FUNCTIONS AS A SELF-REFERENCING INTERFEROMETER

[75] Inventors: Gus P. Tricoles, San Diego; Eugene L. Rope, El Cajon, both of Calif.

[73] Assignee: General Dynamics Corporation, Electronics Division, San Diego, Calif.

[21] Appl. No.: 325,343

[22] Filed: Nov. 27, 1981

[51] Int. Cl.[3] ..... H01Q 1/40; H01Q 1/42; H01Q 13/28

[52] U.S. Cl. ..... 343/872; 343/785; 343/815

[58] Field of Search ..... 343/700 MS, 705, 708, 343/785, 819, 829, 815, 455, 16 M, 824, 825, 833, 834, 872, 873, 893

[56] References Cited

U.S. PATENT DOCUMENTS

| | | | |
|---|---|---|---|
| 3,868,694 | 2/1975 | Meinke | 343/785 |
| 4,010,470 | 3/1977 | Jones, Jr. | 343/708 |
| 4,101,895 | 7/1978 | Jones, Jr. | 343/700 MS |
| 4,162,499 | 7/1979 | Jones, Jr. et al. | 343/700 MS |

FOREIGN PATENT DOCUMENTS

| | | | |
|---|---|---|---|
| 655846 | 1/1963 | Canada | 343/705 |

OTHER PUBLICATIONS

Tricoles et al., "Guide Waves in a Dielectric Slab, Hollow Wedge, and Hollow Cone", Journal of the Optical Society of America, vol. 55, No. 3, pp. 328–330, Mar. 1965.

*Primary Examiner*—Eli Lieberman
*Assistant Examiner*—Michael C. Wimer
*Attorney, Agent, or Firm*—Brown & Martin

[57] ABSTRACT

An antenna-radome structure that functions as a self-referencing interferometer, including a radome having a leading edge and including a plurality of longitudinally disposed slabs of dielectric material having a front edge adjacent the leading edge of the radome; and a corresponding number of antennas disposed normal to the longitudinal axis of the radome and respectively embedded in or placed on the surface of each corresponding dielectric slab. Each antenna is located at a distance from the front end of the corresponding dielectric slab corresponding to a maximum of intensity in an intensity fringe pattern produced by interference between free space waves of a predetermined frequency incident upon the dielectric slab and waves guided by the dielectric slab in response to the incident waves. The thickness of each dielectric slab is tapered for reducing sidelobe levels in the far field pattern of the antenna. A metal foil covers the rear end of each slab for reducing backlobes in the far field antenna pattern and for reducing reflection of the guided waves. Wires are embedded in or placed on the surface of each dielectric slab for defining the shape of the far field of the antenna and for reducing sidelobe levels in the far field pattern of the antenna. Additional antennas may be disposed normal to the longitudinal axis of the radome.

13 Claims, 4 Drawing Figures

INTEGRATED ANTENNA-RADOME STRUCTURE THAT FUNCTIONS AS A SELF-REFERENCING INTERFEROMETER

The Government has rights in this invention pursuant to Contract N00019-79-C-0637 awarded by the Department of the Navy.

BACKGROUND OF THE INVENTION

The present invention generally pertains to antenna systems and is particularly directed to an integrated antenna-radome structure that functions as a self-referencing interferometer.

A self-referencing interferometer is described in U.S. Pat. No. 4,386,356, issued May 31, 1983 to the inventors herein, entitled "Antenna System Employing a Self-Referencing Microwave Interferometer for Direction Finding". The interferometer described therein is based upon the phenomenon that a plane wave incident on a dielectric slab, wedge or hollow shell excites guided waves therein. These waves are coherent with the incident wave and the wave propagated through the dielectric. Therefore, the guided wave interferes with the other waves to form fringe patterns. The spacing "X" of the fringes in a given dimension of the fringe pattern is expressed by the following equation:

$$X=2\pi(K_g-K_o \sin \theta_i)^{-1}$$

where $K_g$ is the propagation constant of the guided wave, $K_o$ is the propagation constant of the incident wave, and $\theta$ is the angle between the normal to the incident surface and the direction of the incident plane waves.

SUMMARY OF THE INVENTION

The present invention also is based upon the phenomenon that a plane wave incident on a dielectric slab, wedge or hollow shell excites guided waves therein. The present invention is an antenna-radome structure that functions as a self-referencing interferometer. The radome has at least one segment of dielectric material having a front edge at or adjacent the leading edge of the radome. A corresponding number of antennas are disposed normal to the longitudinal axis of the radome and are respectively embedded in or placed on the surface of each corresponding dielectric segment, wherein each antenna is located at a distance from the front end of the corresponding dielectric segment corresponding to a maximum of intensity in an intensity fringe pattern produced by interference between free space waves of a predetermined frequency incident upon the dielectric segment and waves guided by the dielectric segment in response to the indicent waves. The term radome, as used herein includes any shaped hollow structure having a leading edge, such as a cone or a wedge.

Preferably, the radome includes a plurality of dielectric segments consisting of dielectric slabs in or on which the antennas are respectively, embedded or placed.

In a preferred embodiment, additional antennas are disposed normal to the longitudinal axis of the radome and are respectively embedded in or placed on the surface of each dielectric segment at different distances from the front end of each dielectric segment for enabling detection of intensity fringe patterns produced in response to incident waves over a wide band of predetermined frequencies.

Additional features of the present invention are described in relation to the description of the preferred embodiment.

DESCRIPTION OF THE PREFERRED EMBODIMENT

Figure 1:
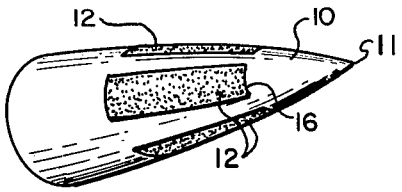
FIG. 1 is a perspective view of a radome having integral dielectric slabs in accordance with a preferred embodiment of the present invention.

Referring to FIG. 1, a preferred embodiment of the antenna-radome structure of the present invention is incorporated in a conical-shaped radome 10 having a leading edge (vertex) 11. The radome 10 includes a plurality of dielectric segments consisting of dielectric slabs 12 longitudinally disposed in the wall of the radome and having their leading edge 16 adjacent the leading edge 11 of the radome 10. Alternatively, the dielectric slabs 12 could extend to the leading edge 11 of the radome; or the radome 10 could be made entirely of dielectric material. In the preferred embodiment, the portion of the wall of the radome 10 not made up of the dielectric slabs 12, is a conductive metal.

Figure 2:
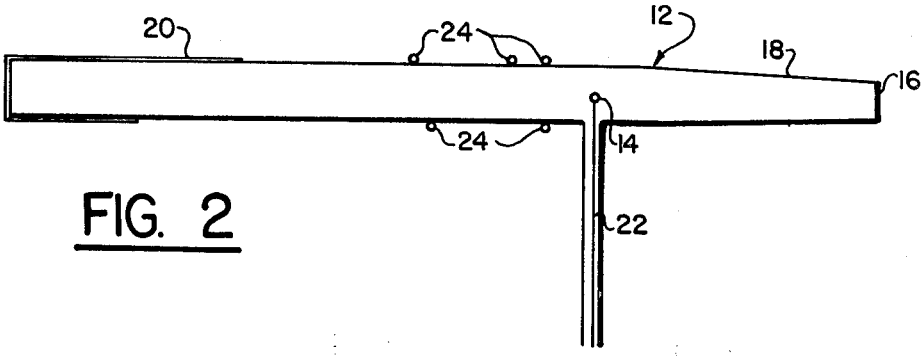
FIG. 2 is a sectional view of a dielectric slab from the radome of FIG. 1 having an antenna embedded therein.

Referring to FIG. 2, each of the dielectric slabs 12 has a dipole antenna 14 embedded therein. The antenna 14 is disposed normal to the longitudinal axis of the radome 10 and is located at a distance from the front 16 of the dielectric slab 12 corresponding to a maximum of intensity in an intensity fringe pattern produced by interference between free space waves of a predetermined frequency incident upon the dielectric slab 12 and waves guided by the dielectric 12 in response to the incident waves. Such distance is determined by analyzing propagation of guided waves and free space waves in accordance with equation (1).

Alternatively, the antenna 14 could be placed on either outer surface of the dielectric slab 12.

The gain of the antenna 14 located at the distance corresponding to a maximum of intensity was measured and found to be approximately 12 dB in comparison to a gain of 2 dB for an isolated dipole antenna not embedded in or placed on a dielectric slab.

A coaxial cable 22 is connected to the antenna 14 and extends into the interior of the radome for propagating electromagnetic waves to and from the antenna 14.

The thickness of the front portion 18 of each dielectric slab 12 is tapered for reducing sidelobe levels in the antenna far field pattern. The thickness increases with increasing distance from the front 16 of the slab 12.

A conductive metal foil 20 covers the rear end of each slab 12 for reducing backlobes in the produced fringe pattern and for reducing reflection of the guided waves. The metal foil 20 contacts the conductive metal wall of the radome 10. Wires 24 are placed on the surface of each dielectric slab 12 for defining the shape of the far field of the antenna 14 and for reducing sidelobe levels. Alternatively, the wires 24 could be embedded in the slab 12.

Figure 3:
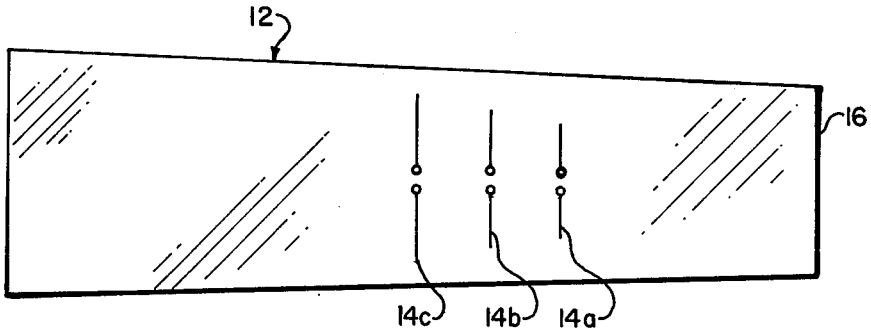
FIG. 3 is a plan view of an alternative preferred embodiment of a dielectric slab from the radome of FIG. 1 having a plurality of antennas placed thereon.

In an alternative preferred embodiment shown in FIG. 3, a plurality of dipole antennas 14*a*, 14*b*, 14*c* are disposed normal to the longitudinal axis of the radome 10 and respectively placed on or imbedded in the surface of each dielectric slab 12 at different distances from the front end 16 of each dielectric slab 12 for enabling detection of intensity fringe patterns produced in response to incident waves over a wide band of predetermined frequencies. The width of the radiating elements of the dipole antennas 14*a*, 14*b*, 14*c* is greater with increasing distance from the front edge 16 of the dielectric slab 12 because the fringe intensity maxima for the lower frequency waves are farther from the leading edge 16 of the slab 12 than are the fringe intensity maxima for the higher frequency waves. The antennas 14*a*, 14*b*, and 14*c* are independent from one another in that each is connected to a transmitter or receiver within the radome by a separate coaxial cable or other transmission line.

Figure 4:
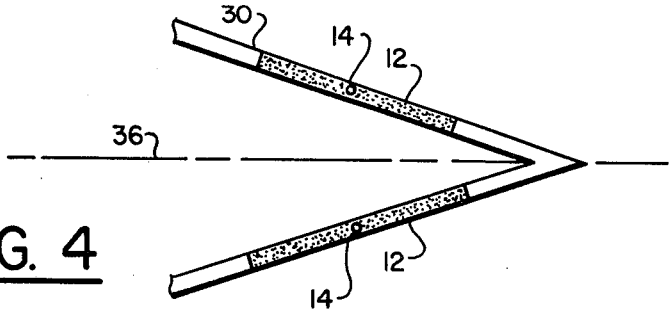
FIG. 4 is a sectional view of a wedge-shaped radome having dielectric slabs, such as are shown in FIGS. 2 and 3.

A monopulse radiation pattern is produced with the antenna-radome structure shown in FIG. 4. In such embodiment, the radome 30 is wedge-shaped and includes a pair of dielectric slabs 12 opposing each other on opposite sides of the wedge. The respective antennas 14 are embedded in the dielectric slabs 12 for producing a monopulse radiation pattern in the plane of symmetry 36 of the wedge 30.

The various features of the antenna-radome structures described with reference to FIGS. 2, 3 and 4 may be combined with each other as appropriate in additional preferred embodiments of the present invention.

We claim:

1. An antenna-radome structure, comprising a radome having a leading edge and including at least one segment of dielectric material having a front edge at or adjacent the leading edge of the radome;

a corresponding number of antennas disposed normal to the longitudinal axis of the radome and respectively embedded in or placed on the surface of each corresponding dielectric segment, wherein each antenna is located at a distance from the front end of the corresponding dielectric segment corresponding to a maximum of intensity in an intensity fringe pattern produced by interference between free space waves of a predetermined frequency incident upon the dielectric segment and waves guided by the dielectric segment in response to said indicent waves.

2. A structure according to claim 1, wherein the thickness of each dielectric segment is tapered for reducing sidelobe levels in the far field pattern of each antenna.

3. A structure according to claims 1 or 2, wherein the radome includes a plurality of dielectric segments consisting of dielectric slabs in or on which the antennas are embedded or placed.

4. A structure according to claim 3, further comprising conductive means covering the rear end of each slab for reducing backlobes in the far field pattern of each antenna and for reducing reflection of the guided waves.

5. A structure according to claim 3, wherein the dielectric slabs are longitudinally disposed.

6. A structure according to claims 1 or 2 further comprising wires embedded in or placed on the surface of each dielectric segment for defining the shape of the far field of each antenna and for reducing sidelobe levels in said far field pattern.

7. A structure according to claim 1, further comprising additional antennas disposed normal to the longitudinal axis of the radome and respectively embedded in or placed on the surface of each dielectric segment at different distances from the front end of each dielectric segment for enabling detection of intensity fringe patterns produced in response to incident waves over a wide band of predetermined frequencies.

8. A structure according to claim 7, wherein the radome includes a plurality of dielectric segments consisting of dielectric slabs in or on which the antennas are embedded or placed.

9. A structure according to claims 1 or 7, wherein the radome is conical.

10. A structure according to claims 1 or 7, wherein the radome is wedge-shaped.

11. A structure according to claim 10, wherein the radome includes a pair of dielectric segments opposing each other on opposite sides of the wedge, in or on which segments the respective antennas are embedded or placed for producing a monopulse radiation pattern in the plane of symmetry of the wedge.

12. A structure according to claim 1, wherein each antenna is a dipole antenna.

13. A structure according to claim 7, wherein the dimensions of the respective antennas in or on each dielectric segment are greater with increasing distance from the front edge of the dielectric segment.

* * * * *